United States Patent [19]

Willson

[11] 4,136,662

[45] Jan. 30, 1979

[54] WOOD BURNING STOVE

[76] Inventor: Allan C. Willson, P.O. Box 65, Mill City, Oreg. 97360

[21] Appl. No.: 836,502

[22] Filed: Sep. 26, 1977

[51] Int. Cl.[2] ..... F24C 1/14

[52] U.S. Cl. ..... 126/61; 126/77; 126/200

[58] Field of Search ..... 126/60–67, 126/77, 112, 200; 49/366, 367, 394; 110/302, 310; 251/297; 16/82, DIG. 17

[56] References Cited

U.S. PATENT DOCUMENTS

| | | | |
|---|---|---|---|
| 1,136,615 | 4/1915 | Rice | 126/77 |
| 1,349,562 | 8/1920 | Curry | 126/200 |
| 1,510,391 | 9/1924 | Feely | 110/310 X |
| 2,948,276 | 8/1960 | Harding | 126/77 X |
| 2,967,522 | 1/1961 | Takahashi | 126/77 X |
| 3,757,766 | 9/1963 | Stevenson | 126/60 |

*Primary Examiner*—William F. O'Dea
*Assistant Examiner*—William E. Tapolcai, Jr.
*Attorney, Agent, or Firm*—Oliver D. Olson

[57] ABSTRACT

A wood burning stove is formed with double front and rear side walls of heat conductive metal interconnected by heat conductive spacer fins and providing air passageways by which room air is heated by conduction from the walls which are heated by the burning of wood deposited on a firebox grate made up of spaced bricks supported by metal holders secured in heat conducting relation to said inner side walls. The rear side air passageway is divided into central and outer vertical sections the central one of which is closed at the bottom end and communicates with the atmosphere through an opening in the outer wall intermediate its vertical ends and with the stove interior above the firebox and below the grate through openings in the inner wall intermediate its vertical ends and adjacent its bottom end, respectively. A vertical baffle between these inner and outer walls separates said intermediate openings from each other, and a thermostatically controlled damper associated with the opening in the outer wall controls the amount of room air delivered either under the firebox grate or above it. The front side air passageway is divided into upper and lower sections separated by a viewing box closed at its outer end by a glass window and removably closed at its inner end by a pair of hinged doors.

20 Claims, 6 Drawing Figures

WOOD BURNING STOVE

BACKGROUND OF THE INVENTION

This invention relates to wood burning stoves, and more particularly to a wood burning stove constructed to provide maximum wood burning efficiency.

Wood burning stoves heretofore have been characterized by a single wall construction, whereby heat produced by the burning of wood within the stove is conducted through the single wall to air which is brought into direct contact with the outer surface of the walls. The efficiency of heat transfer of such stoves is quite low. Additionally, the excessive temperature at the outer surface of the stove requires correspondingly excessive spacings from room walls.

SUMMARY OF THE INVENTION

In its basic concept, the stove of this invention is of double wall construction forming heat transfer passageways for the heating of external air some of which is directed, preferably by thermostatic control, into the stove above and below the firebox.

It is by virtue of the foregoing basic concept that the principal objective of this invention is achieved; namely, to overcome the disadvantages and limitations of prior wood burning stoves.

Another objective of this invention is the provision of a wood burning stove which may be located at significantly shorter distances from room walls than has been afforded heretofore.

Still another objective of this invention is the provision of a wood burning stove construction which enables thermostatic control of delivery of external air to the interior of the stove above and below a firebox, for maximizing efficiency of burning of wood and other solid fuels.

A further objective of this invention is the provision of a wood burning stove provided with a large window by which to view the fire above a firebox, and means for keeping the window clean of smoke particles.

A still further object of this invention is the provision of a wood burning stove of simplified but sturdy construction for economical manufacture and long service life with minimum maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
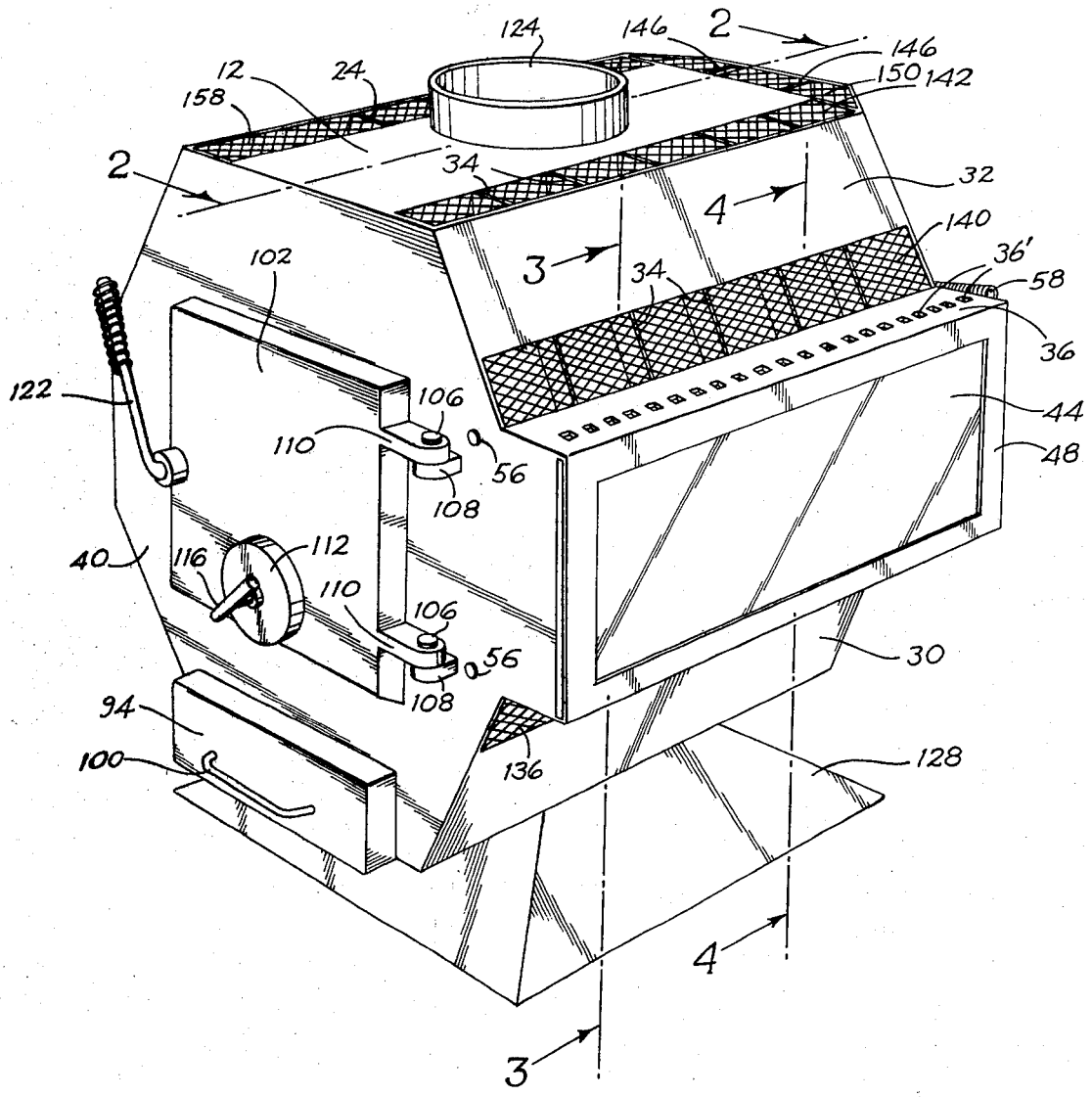
FIG. 1 is a perspective view of a wood burning stove embodying the features of this invention.

As illustrated in the drawings, the stove is provided with a bottom wall 10, a top wall 12 and double front and rear side walls, all of heat conductive metal. The double rear wall includes an inner wall formed of lower section 14 which extends angularly upward and outward from the bottom wall and upper section 16 which extends angularly upward and inward from the upper edge of the lower section to the top wall. The double rear wall also includes an outer wall formed of lower section 18 which is parallel to lower inner section 14, upper section 20 which is parallel to upper inner section 16, and intermediate section 22 which interconnects the upper and lower outer sections. The inner and outer wall sections are spaced apart by heat conductive fins 24 to provide passageways between them, as described more fully hereinafter.

The double front side wall is formed of the lower inner wall section 26 which extends angularly upward and outward from the bottom wall, the upper inner wall section 28 which extends angularly downward and outward from the top wall, and the lower and upper outer wall sections 30 and 32 respectively, spaced outwardly from the inner wall sections by heat conductive fins 34 to provide passageways between them. The inner and outer front side walls are spaced apart at the inner ends, and said inner ends are closed by upper and lower horizontal plates 36 and 38 both of which project forwardly beyond the outer front side wall.

The front and rear ends of the stove are closed by front and rear end walls 40 and 42, respectively, which extend to the outer side wall sections and also form end closures for the upper and lower plates 36 and 38. These plates, together with said end closure walls, thus form a rectangular fire-viewing box. The outer end of the box is closed by a window 44 of heat resistant glass. It is mounted removably in a channel formed between inner and outer peripheral flanges 46 and 48 which join the outer end portions of the upper and lower plates 36 and 38 to the end walls 40 and 42. As best shown in FIG. 1, an opening is provided between the front end wall 40 of the stove and the adjacent outer flange segment 48 for passage of the glass for installation and removal.

The upper and lower plates 36 and 38 are provided with a multiplicity of openings 36' and 38', respectively located adjacent the inner surface of the window 44. As explained more fully hereinafter, these openings afford passage of air across the inner surface of the window to maintain the latter free of soot and other solid particles resulting from combustion of wood or other solid fuel within the stove.

Figure 3:
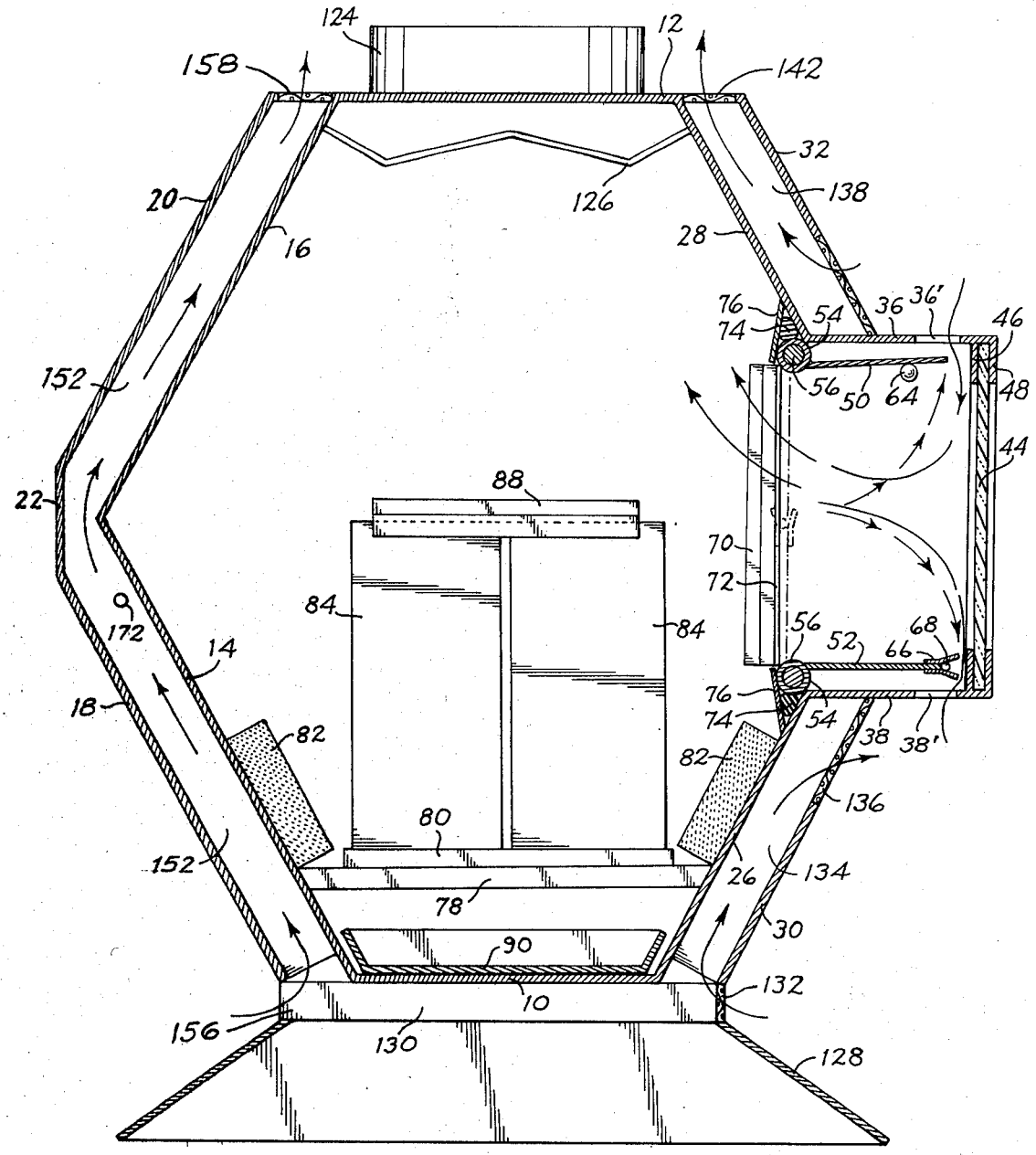
FIG. 3 is a sectional view taken on the line 3—3 in FIG. 1, the hinged doors associated with the viewing window being shown open in full lines and closed in broken lines.
Figure 4:
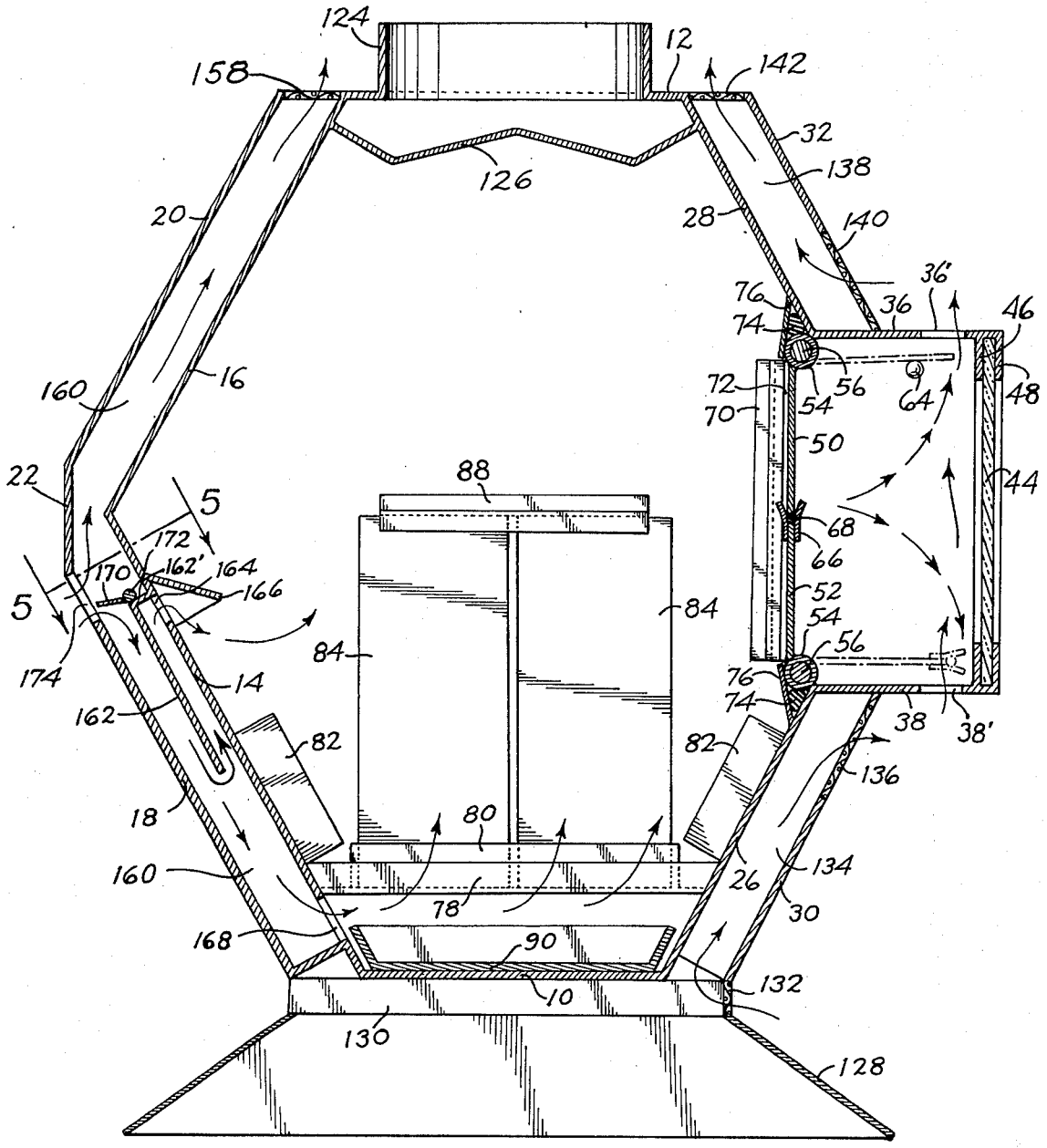
FIG. 4 is a sectional view taken on the line 4—4 in FIG. 1, the hinged doors associated with the viewing window being shown closed in full lines and open in broken lines.

The inner end of the rectangular box is removably closed by means of a pair of hinged doors 50 and 52. As best illustrated in FIGS. 3 and 4, each of the doors has a pipe 54 secured along its outer edge, off center with respect to the plane of the door. A pivot shaft 56 is secured in each pipe and extends beyond the ends of the door. The front end of each shaft extends through a bearing opening provided in the front end wall 40 of the stove. The rearward end of each shaft projects through a similar bearing opening in the rear end wall 42 of the stove and is fitted at its outermost end with a handle 58 for manually manipulating the doors between open and closed conditions. In the embodiment illustrated, each handle is provided with a perforate connecting base 60 for receiving the shaft, and a set screw by which to secure the base to the shaft.

Figure 2:
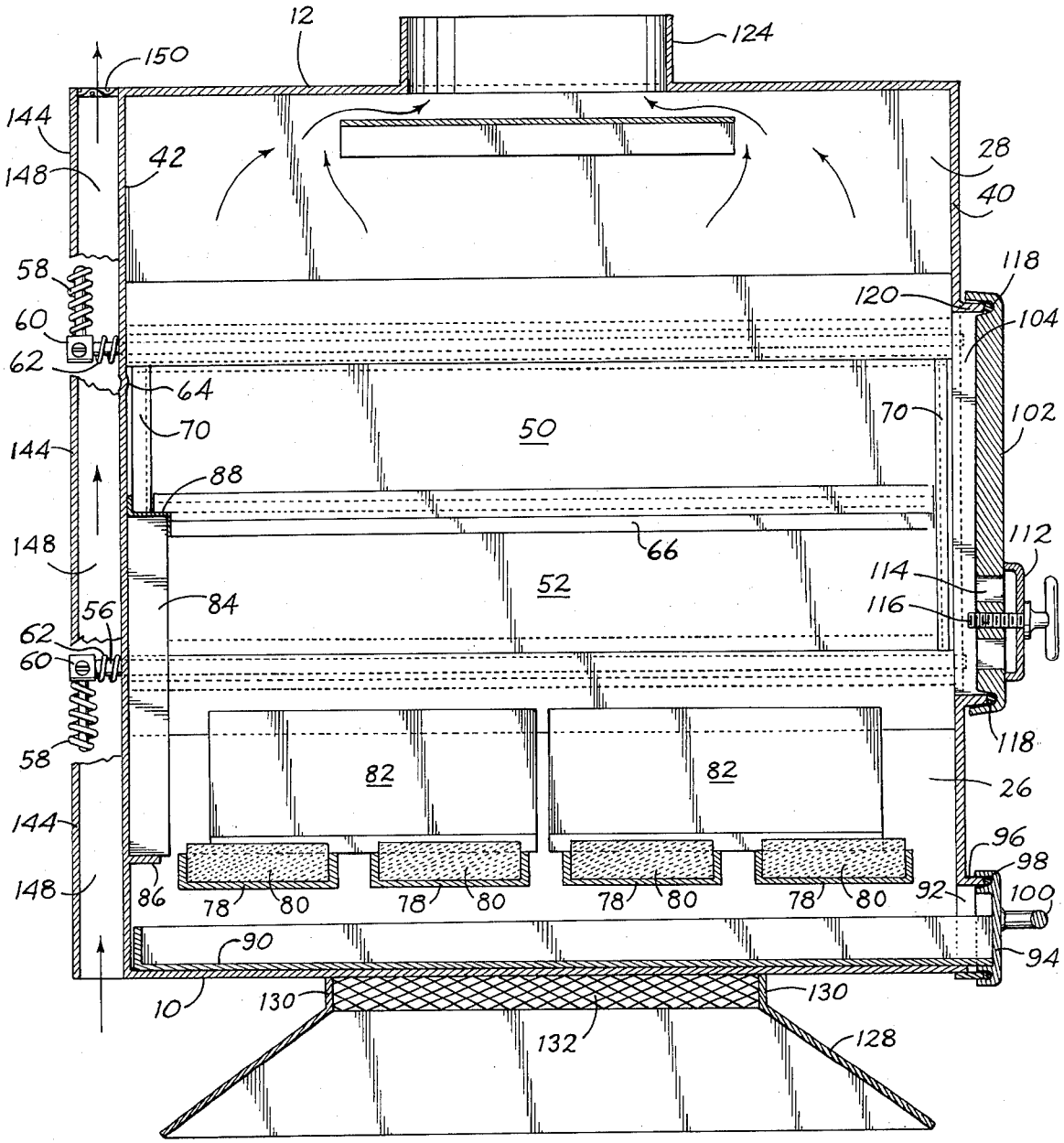
FIG. 2 is a sectional view taken on the line 2—2 in FIG. 1.

Means is provided for retaining the doors releasably in the open position illustrated in FIG. 3. In the embodiment illustrated, a coil spring 62 encircles each of the rearward projecting portions of the shafts 56 and is interposed between the outer surface of the rear end wall 42 and the connecting base 60 of the associated handle. Each coil spring thus urges the shaft resiliently rearward so that the rearward end of each door is brought into resilient abutment with the inner surface of the rear end wall 42 of the stove. An inwardly projecting detent 64 (FIGS. 2 and 4), associated with the upper door 50, is formed on the rear end wall of the stove in a position to be intercepted by the upper door as the latter is pivoted upwardly to the open position. Thus, as the door is moved to its fully open position, its rearward edge rides over the inwardly projecting detent, accommodated by compression of the associated coil spring 62 which allows the rearward end of the door to move inwardly relative to the confronting inner surface of the rear end wall of the stove. Then, after the rearward edge of the door has passed upward over the detent, the coil spring 62 urges the rearward edge back against the rear wall of the stove. The detent thus prevents the door from swinging freely downward to the closed position.

In the closed position shown in FIG. 4, the doors interengage with an airtight seal. The inner edge of one of the doors, the lower door 52 illustrated, is provided with an outwardly facing channel member 66 containing a length of ceramic rope 68 arranged to be engaged by the confronting inner edge of the upper door 50, when the doors are swung closed, to form an airtight seal between them. Channel shaped retainers 70 for ceramic rope 72 are integrated with the front and rear end walls 40 and 42 to provide airtight seals at the front and rear ends of doors 50 and 52 when closed. Ceramic rope 74 also is secured in the spaces provided between the pipes 54 and flanges 76 to form airtight seals along the outer edges of the doors.

A spaced distance above the bottom wall 10, there is provided a firebox grate. In the preferred embodiment illustrated, the grate comprises a plurality of shallow heat conductive metal trays 78, each having bottom and side walls. The trays are spaced apart between the front and rear end walls and are secured, as by welding, in heat conductive contact with the lower sections of the front and rear inner side walls 26 and 14. Each of the trays is dimensioned to receive and support a fire brick 80 of conventional construction. Additional fire bricks 82 are deposited freely against the inner surfaces of the upwardly diverging lower sections of the front and rear side walls, the bottom sides of the bricks resting against the upper edges of the trays 78. As illustrated, two such bricks are provided at each side of the grate, extending between the front and rear end walls of the stove (FIG. 2), to form the side walls of a firebox the bottom of which is formed by the grate. The rear end of the firebox is provided by a pair of bricks 84 placed against the rear end wall of the stove and supported between a bottom flange 86 and a top bracket 88.

It is to be noted that the spacing between the trays and bricks forming the firebox grate allows ashes produced by the burning of wood or other solid fuel to fall by gravity downward toward the bottom wall 10 of the stove. An ash-receiving tray 90 is provided below the grate, being supported freely on the bottom wall of the stove. The ash tray extends from the rear end wall of the stove through an opening 92 in the bottom end of the front end wall 40 of the stove. The front end of the ash tray is formed in the shape of a rectangular box 94 provided with a peripheral groove for reception therein of a peripheral flange 96 which extends outwardly about the bottom opening in the front end wall of the stove. An airtight seal preferably is provided between the flange and groove by placing in the latter a length of ceramic rope 98 to provide a resilient abutment for the flange. A bail type handle 100 projects outwardly from the front closure 94 of the ash tray to facilitate handling of the tray.

Access to the firebox, for the introduction of wood or other solid fuel, is provided by a front end door 102 which is arranged to removably close an opening 104 in the front end wall 40 of the stove. The door is mounted pivotally on the front end wall of the stove by means of a pair of coaxial pivot pins 106 mounted on brackets 108 projecting from the front end wall and extending through openings in lateral tabs 110 projecting from the door. The door is provided with the usual air adjusting damper, comprising a plate 112 overlying a plurality of openings 114 through the door and adjustable toward and away from the outer surface of the door by means of a threaded screw 116.

The door is provided with an inner peripheral groove in which is retained a length of ceramic rope 118, for sealing engagement with the confronting edge of the outwardly extending peripheral flange 120 which surrounds the opening 104 in the front end wall of the stove.

A cam-type latch (not shown) is arranged to slidably engage the inner side of front end wall 40 for drawing the door 102 toward the front end wall during closing of the door, to draw the ceramic rope 118 tightly against the peripheral flange 120 of the opening and thus provide an airtight seal. The latch is connected to a handle 122 on the outer side of the door for rotating the latch between wall-engaging and wall-disengaging positions, as will be apparent.

An opening in the top wall 12 is surrounded by an upstanding chimney pipe 124 by which to couple the stove to a flue. The pipe may be positioned closer to the rear end wall 42 if it is desired to increase the area of the top wall for cooking purposes. A baffle 126 preferably is provided to underlie the chimney opening a spaced distance below the top wall. The baffle serves to require combustion gases to take a longer path to the chimney, thereby lowering the temperature of stack gases.

The stove preferably is supported on a pedestal so as to be elevated above the floor. In the embodiment illustrated, the pedestal includes a lower section which is formed of metal plates 128 in the shape of a truncated pyramid. The upper end of this truncated pyramid is connected to the bottom wall 10 of the stove by means of a pair of narrow bars 130 extending parallel to but inwardly of the front and rear end walls of the stove. The front side edges of the bars are joined by a length of decorative expanded metal 132 or other desirable form of perforate membrane which enables the passage of air through it, as explained more fully hereinafter. The rear side ends of the bars may be similarly joined, but since that side normally is not exposed to view, it may be left open, as illustrated.

As previously mentioned, the double front and rear side wall construction provides passageways for external, room air. Referring primarily to FIGS. 3 and 4 of the drawings, the passageway 134 between the lower inner and outer front wall sections 26 and 30 provides for the passage of air upward through the perforate decorative membrane 132 of the base and thence outward through an opening in the upper end portion of the lower section of the outer front side wall. This opening also preferably is decorated with an expanded metal plate 136 or other perforate membrane. As this air passes upwardly through the passageway 134, it is heated by contact with the heat conductive metal surfaces of the lower inner and outer sections and fins 34 of the front side wall which, in turn, have been heated by the combustion of wood or other solid fuel within the stove. Additional heat is transferred to this lower inner wall by virtue of the heat conductive engagement of the grate-forming trays 78.

The passageway 138 formed between the upper inner and outer sections 28 and 32 of the front side wall also accommodates the upward passage of air through an opening in the lower portion of the outer wall section 21 and thence upwardly through the open upper end between the inner and outer wall sections. These openings also preferably are decorated with expanded metal plates 140 and 142, respectively, or other perforate membranes. As the air passes upwardly through this passageway, it is heated by contact with the surfaces of the upper sections 28 and 32, and spacer fins 34 of the front side wall, as will be understood.

In the preferred embodiment illustrated, the rear end wall 42 of the stove also is provided as an inner wall of a double wall construction. An outer wall 144 is provided, spaced rearwardly of the inner wall by means of heat conductive fins 146. The upper and lower ends of the passageway 148 between the walls are open to allow the upward passage of air therethrough, the upper open end preferably being decorated by expanded metal 150 or other perforate membrane.

The passageway between the inner and outer rear side walls is divided into a central section and at least two opposite end sections between the front and rear end walls 40 and 42 of the stove. In the embodiment illustrated two end sections are thus provided (FIG. 5) by means of the pair of spaced fins 24 extending from top to bottom.

The front and rear end passageways 152 and 154 thus formed are open at their top and bottom ends (FIG. 3) allowing the passage of outside, room air upwardly through the rear opening 156 in the base of the stove, thence upward through the open bottom ends of the passageways and up through the open top which, as before, preferably is decorated by a piece of expanded metal 158 or other perforate membrane. As this air passes upwardly through the passageway, it is heated by contact with the inner and outer rear side wall sections and separating fins 24.

It is to be noted that the passageways between the inner and outer rear side wall sections are constricted in the intermediate portion where the upper and lower inner wall sections 16 and 14 join and the intermediate outer wall section 22 joins the upper and lower outer wall sections 20 and 18. This constriction produces a venturi effect, the increased velocity of air moving upwardly through this area tending to cool the intermediate outer wall section 22. Accordingly, the rear side wall of the stove may be placed closer to a room wall than would otherwise be permitted.

Figure 5:
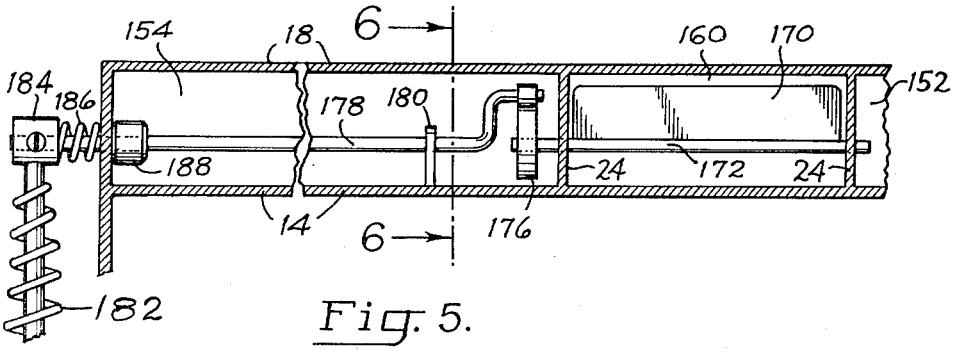
FIG. 5 is a foreshortened, fragmentary sectional view taken on the line 5—5 in FIG. 4.
Figure 6:
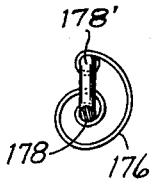
FIG. 6 is a sectional view taken on the line 6—6 in FIG. 5.

The central passageway 160 between the inner and outer rear side walls contains automatic damper means by which to control the admission of outside air to the interior of the stove, above and below the firebox grate. Referring to FIGS. 4-6, a baffle plate 162 is provided with an upper offset portion 162' which is secured to the outer surface of the lower section 14 of the inner rear side wall of the stove. The baffle plate extends laterally between the fins 152 and extends downwardly from the offset section. An opening 164 is provided in the lower inner wall section 14 adjacent the upper offset portion 162' of the baffle plate and this opening is shielded on the inner side of the stove by a canopy 166 which directs air downwardly and inwardly toward the firebox, as indicated by the arrows. An opening 168 also is provided in the inner wall section 14 at the lower end thereof for direction air into the space under the firebox grate. The width of the space between the baffle plate and the lower inner wall section 14 preferably is about half the width of the space between the baffle plate and the lower outer wall section 18.

At the upper end of the baffle plate 162, adjacent the offset portion, a damper blade 170 extends between the passageway-defining fins 152 and is mounted pivotally therein on a pivot shaft 172 which extends through openings in the fins. The baffle blade is disposed adjacent an opening 174 in the outer lower section 18 of the rear side wall and is movable across the space between the baffle 162 and the outer wall section 18 so as to control the magnitude of communication between the opening 174 in the outer wall and the passageway between said wall and baffle plate 162.

Means preferably is provided for controlling adjustment of the damper blade 170 automatically in response to combustion conditions within the stove, whereby to maximize the efficiency of combustion. Referring particularly to FIG. 5 of the drawings, one end of the damper shaft 172 which extends through the adjacent fin 152, secures one end of a conventional bimetal thermostat 176. The opposite end of the bimetal is secured to the offset inner end 178' of a shaft 178 which extends laterally through the adjacent, rear passageway 156 and projects outwardly through the rear and wall 42 of the stove. A bracket 180 within the passageway is provided with an opening through which the shaft extends. This opening, together with the opening through the rear end wall 42, provide bearings supporting the shaft for rotation.

The outer end of the shaft 178 mounts a handle 182, as by means of a set screw in the connecting base 184 of the handle. A coil spring 186 surrounds the outer portion of the shaft between the connecting end of the handle and the outer surface of the back wall. A friction block 188 secured to the shaft within the passageway 156 is drawn into frictional engagement with the inner surface of the rear wall 42, by action of the spring. This frictional contact of the block with the wall secures the shaft in any desired position of rotational adjustment by manual manipulation of the handle. This position of adjustment is maintained while operation of the bimetal thermostat 176 effects automatic adjustment of the damper blade 170.

With a wood fire burning in the firebox, the operation of the stove is as follows: The inner walls of the stove are heated as a result of burning of the fuel. Room air passes upwardly through the passageways 134, 138, 154 and 156 provided by the double front and rear side walls, as well as the passageway 148, provided by the double rear end wall. This double wall construction, together with the heat conducting fins 24, 34, 146 and 152 extending between the inner and outer walls, provides additional heat conductive metal surfaces for conducting heat out of the firebox and into the room. The heat conductive metal trays 78 which form a part of the firebox grate also contribute materially to this increased heat conduction.

With reference to FIG. 4, room air also enters the central passageway 160 between the inner and outer rear side walls, through the opening 174 associated with the thermostatically controlled baffle 162. Initially, when the stove is cold, the baffle is substantially fully open, allowing maximum outside air to pass downwardly in the space between the baffle 162 and the outer wall section 18. The majority of such outside air enters through the lower opening 168 and passes upwardly through the spaces between the firebox grate bricks 80 to enhance the combustion of fuel.

As the temperature within the stove increases, the bimetal thermostat operates to pivot the baffle plate progressively counterclockwise to decrease the opening to the space behind the baffle 162. Thus, progressively less outside air is allowed to enter said space and to pass downwardly to the bottom end of the baffle. At this point a greater proportion of the heated air passes upwardly through the space between the baffle and the inner wall section 14, the remaining proportion of air progressing downwardly through the opening 168 and thence inward under the firebox grate. From there the air passes upward through the spaces between the bricks forming the grate, supplying additional oxygen for combustion. The proportion of air that passes upward through the space between the baffle and inner wall section, then enters the combustion area above the firebox through the opening 164 in the inner wall.

Thus, the hotter the fire within the stove, the less outside air is required to assist combustion, and of that lesser amount a greater proportion is delivered to the space above the firebox to maximize complete combustion and thereby minimize the expulsion of pollutants to the atmosphere.

Let it be assumed, for purposes of this explanation, that the pair of doors 50 and 52 at the inner end of the viewing box have been closed, as illustrated in FIG. 4. In this position the inner longitudinal edge of the upper door has been received within the groove provided by the channel member 66 secured to the inner edge of the lower door. A substantially air-tight seal thus is provided by abutment of the lower edge of the upper door against the ceramic rope contained within the channel.

Further, it is to be noted that the doors are mounted eccentrically with respect to their pivot shafts 56 and that in moving to the closed position illustrated in FIG. 4, the doors have crossed over center with respect to their pivot shafts. The closed doors thus are secured against inadvertent opening, since they cannot return over center without manual assistance. The doors are limited in their movement to the closed position illustrated in FIG. 4 by abutment of the sides of the doors against the ceramic rope seals 72.

With the doors 50 and 52 closed, room air may enter the viewing box through openings 38' and there be warmed, after which it exits the openings 36'. This affords a further degree of heating of the room.

Let it now be assumed that it is desired to open the doors 50 and 52 so that the occupants of the room may view the fire within the stove. The handles 58 at the rear end of the stove are turned in the direction to pivot the doors outwardly toward the upper and lower plates 36 and 38 of the viewing box. The upper door passes over the detent 64, by compression of the spring 62, and then returns into abutment with the rear end wall 42 of the stove, to be retained in the open position illustrated in FIG. 3. In this position the large glass window 44 affords full view of the fire in the stove.

Further, with the doors located in the open position of FIG. 3, outside air enters the viewing box through the multiplicity of openings 36' and 38' and in the upper and lower plates 36 and 38. The air sweeps across the inner surface of the glass window to keep it clean of all soot and other solid particles resulting from the combustion of fuel within the stove. In this regard, it has been found that continuous use of the stove in the burning of wood for several months has required no cleaning of the glass window.

After the air has swept across the inner surface of the window, it is directed into the stove above the firebox, thereby assisting in complete combustion of the fuel.

As mentioned previously, the provision of double walls at the front and rear sides and rear end of the stove reduces the temperature of the outer walls to a significant degree, permitting the stove to be installed much closer to room walls than is permitted with stoves of single wall construction. Furthermore, the venturi effect created at the intermediate space of the end passageway 154 and 156 between the inner and outer rear side walls, reduces the temperature of the intermediate outer wall section 22 still further, allowing the inner side wall of the stove to be positioned still closer to an adjacent room wall.

The burning of wood or other solid fuel within the firebox creates a proportion of inorganic ash. These particles of ash gravitate downward through the spaces between adjacent bricks 80 forming the firebox grate, and are deposited in the ash tray 90. The tray is removed periodically to empty it of the accumulated ash.

It will be apparent to those skilled in the art that various changes may be made in the size, shape, type, number and arrangement of parts described hereinbefore. For example, the viewing box and window and closure door assembly may be omitted, in which case the passageways 134 and 138 may form a single passageway and the openings decorated by the expanded metal plates 136 and 140 would be omitted. The damper system may be utilized in the front passageway, if the viewing box is omitted. The double closure doors 50 and 52 may be hinged along their outer vertical edges instead of their outer horizontal edges, if the viewing box is dimensioned appropriately, although the arrangement illustrated is preferred. The double doors also may be replaced by a single door if dimensions permit. The thermostatic control 176 may be omitted if manual control by handle 182 is deemed sufficient, in which case the two shafts 172 and 178 will be joined as one. These and other modifications and changes may be made, as desired, without departing from the spirit of this invention.

Having now described my invention and the manner in which it may be used, I claim:

1. A stove for burning solid fuel, comprising:

(a) top, bottom and front and rear end walls, (b) inner and outer front and rear side walls extending between the top, bottom and front and rear end walls and forming front and rear side room air passageways which are open at their top and bottom ends for the passage of room air upwardly therethrough, and also forming between the inner and outer walls of one of said side walls a combustion air passageway which is separated laterally from an adjacent room air passageway, the combustion air passageway being closed at its bottom end, (c) a fuel-supporting grate above the bottom wall, (d) an air opening in the outer side wall associated with the combustion air passageway intermediate the upper and lower ends of said side wall for admitting air into the combustion air passageway, (e) a pair of air openings in the inner side wall associated with the combustion air passageway one intermediate the upper and lower ends of said wall and the other adjacent the lower end thereof for admitting air from said combustion air passageway into the interior of the stove above and below the fuel-supporting grate, (f) a baffle member within said combustion air passageway separating the intermediate openings in the inner and outer side walls from each other, the baffle member extending downwardly from said opening in the outer side wall and terminating above the opening adjacent the lower end of the inner side wall, and (g) a damper member in said combustion air passageway movable between positions varying the degree of admittance of air through the opening in the outer side wall to the space between the baffle member and the outer side wall.

2. The stove of claim 1 wherein the baffle member is disposed in the passageway parallel to the inner and outer side walls and spaced from the inner side wall about half its distance from the outer side wall.

3. The stove of claim 1 including thermostat means coupled to the damper member for moving the latter in response to changes in temperature within the stove.

4. The stove of claim 1 including control handle means coupled to the damper member for moving the latter between said positions.

5. The stove of claim 4 including thermostat means coupling the control handle means to the damper member for moving the latter in response to changes in temperature within the stove.

6. The stove of claim 1 wherein the inner and outer rear side walls extend angularly upward and rearward from the bottom wall to a point substantially midway of their vertical height and then angularly upward and forward to the top wall, the spacing between said inner and outer rear side walls at said midway point being constricted relative to the spacing above and below said midway point.

7. The stove of claim 1 including divider means between the inner and outer walls of one of said side walls for forming a plurality of laterally separated passageways, the air openings, baffle member and damper member being associated with one of said laterally separated passageways.

8. The stove of claim 1 including a viewing box intermediate the vertical ends of the inner and outer front side walls communicating at its inner end with the interior of the stove above the fuel-supporting grate for viewing fire within the stove, the viewing box dividing the passageway between the inner and outer front side walls into upper and lower passageways, openings being provided in the outer side wall adjacent the upper end of the lower passageway and adjacent the lower end of the upper passageway, for the passage of air upwardly through said passageways, and a transparent window closing the outer end of the viewing box.

9. The stove of claim 8 wherein the viewing box extends between the front and rear ends of the stove and the front and rear end walls of the stove also close the front and rear ends of the viewing box.

10. The stove of claim 8 wherein the viewing box has openings in its top and bottom adjacent the window for the passage of air along the inner surface of the window.

11. The stove of claim 8 including closure means adjacent the inner end of the viewing box movable between a position closing the inner end of the viewing box and a position opening the inner end of the viewing box for viewing fire within the stove.

12. The stove of claim 11 wherein the closure means comprises a pair of doors disposed adjacent each other and traversing the inner end of the viewing box, hinge means mounting the outer end of each door for swinging movement of each door between a closed position extending across a corresponding portion of the inner end of the viewing box and an open position extending forwardly into the viewing box adjacent a wall of the latter.

13. The stove of claim 11 wherein the closure means comprises a pair of doors disposed one above the other and traversing the inner end of the viewing box, hinge means mounting the upper end of the upper door and the lower end of the lower door for swinging movement of the doors between a closed position entending across the inner end of the viewing box and an open position extending forwardly into the viewing box adjacent the upper and lower walls of the latter, and retainer means in the stove adjacent the upper closure door for securing the latter in its open position.

14. The stove of claim 13 wherein the retainer means comprises a detent on one of the end walls of the stove extending inwardly thereof, and resilient means engaging the upper door for urging the latter resiliently against the said one end wall, whereby the detent presents an obstacle to movement of the upper door across it.

15. The stove of claim 8 wherein:

(a) the viewing box extends between the front and rear ends of the stove and the front and rear end walls of the stove also close the front and rear ends of the viewing box, (b) the viewing box has openings in its top and bottom adjacent the window for the passage of air along the inner surface of the window, and (c) closure means adjacent the inner end of the viewing box movable between a position closing the inner end of the viewing box and the position opening the inner end of the viewing box for viewing fire within the stove, the closure means comprising:

(1) a pair of doors disposed one above the other and traversing the inner end of the viewing box, (2) hinge means mounting the upper end of the upper door and the lower end of the lower door for swinging movement of the doors between a closed position extending across the inner end of the viewing box and an open position extending forwardly into the viewing box adjacent the upper and lower walls of the latter, and (3) retainer means in the stove adjacent the upper closure door for securing the latter in its open position, the retainer means comprising a detent on one of the end walls of the stove extending inwardly thereof, and resilient means engaging the upper door for urging the latter resiliently against the said one end wall, whereby the detent presents an obstacle to movement of the upper door across it.

16. In a stove for burning solid fuel on a grate located above the bottom walls of the stove and having one wall of the stove comprising inner and outer walls forming an air passageway between them, the combination therewith of an air control comprising:

(a) an air opening in the outer side wall intermediate the upper and lower ends thereof for admitting air into the passageway, (b) a pair of air openings in the inner side wall one intermediate the upper and lower ends thereof and the other adjacent the lower end thereof for admitting air from said passageway into the interior of the stove above and below the fuel-supporting grate, (c) a baffle member in said passageway separating the intermediate openings in the inner and outer side walls from each other, the baffle member extending downwardly from said opening in the outer side wall and terminating above the opening adjacent the lower end of the inner side wall, and (d) a damper member in said passageway movable between positions varying the degree of admittance of air through the opening in the outer side wall to the space between the baffle member and the outer side wall.

17. The combination of claim 16 wherein the baffle member is disposed in the passageway parallel to the inner and outer walls and spaced from the inner side wall about half its distance from the outer side wall.

18. The combination of claim 16 including thermostat means coupled to the damper member for moving the latter in response to changes in temperature within the stove.

19. The combination of claim 16 including control handle means coupled to the damper member for moving the latter between said positions.

20. The combination of claim 19 including thermostat means coupling the control handle means to the damper member for moving the latter in response to changes in temperature within the stove.

* * * * *